US009212845B2

(12) United States Patent
Nakagawa et al.

(10) Patent No.: US 9,212,845 B2
(45) Date of Patent: Dec. 15, 2015

(54) CASING OF OUTDOOR UNIT IN AIR CONDITIONING DEVICE

(71) Applicant: DAIKIN INDUSTRIES, LTD., Osaka-shi, Osaka (JP)

(72) Inventors: Yuusuke Nakagawa, Sakai (JP); Mikio Kagawa, Sakai (JP); Shigeki Kamitani, Sakai (JP)

(73) Assignee: DAIKIN INDUSTRIES, LTD., Osaka (JP)

( * ) Notice: Subject to any disclaimer, the term of this patent is extended or adjusted under 35 U.S.C. 154(b) by 0 days.

(21) Appl. No.: 14/361,541

(22) PCT Filed: Oct. 10, 2012

(86) PCT No.: PCT/JP2012/076218

§ 371 (c)(1),
(2) Date: May 29, 2014

(87) PCT Pub. No.: WO2013/080677

PCT Pub. Date: Jun. 6, 2013

(65) Prior Publication Data

US 2014/0339968 A1 Nov. 20, 2014

(30) Foreign Application Priority Data

Nov. 30, 2011 (JP) ..... 2011-262432

(51) Int. Cl.
*A47B 81/00* (2006.01)
*F25D 23/00* (2006.01)
(Continued)

(52) U.S. Cl.
CPC ..... *F25D 23/003* (2013.01); *F24F 1/50* (2013.01); *F24F 1/56* (2013.01)

(58) Field of Classification Search
CPC ..... A47B 31/02; A47B 47/02; A47B 47/03; A47B 47/045; A47B 47/0083; A47B 96/14; A47B 96/1433; A47B 2096/1491; F25D 23/003; F24F 1/50; F24F 1/56
USPC ..... 312/400, 140, 236, 100, 101, 265.5, 312/265, 6, 257.1, 263, 265.1–265.4; 211/26, 191, 192; 108/156; 62/259.2; 454/184
See application file for complete search history.

(56) References Cited

U.S. PATENT DOCUMENTS 1,129,040 A * 2/1915 McClure ..... 138/156
1,369,109 A * 2/1921 Huston ..... 108/156
(Continued)

FOREIGN PATENT DOCUMENTS

JP 2008-190820 A 8/2008
JP 2009-127991 A 6/2009
JP 2011-196665 A 10/2011

OTHER PUBLICATIONS

Abstract and drawing for KR 1418536 Jul. 2014.*

*Primary Examiner* — Janet M Wilkens
(74) *Attorney, Agent, or Firm* — Birch, Stewart, Kolasch & Birch, LLP

(57) ABSTRACT

A casing of an outdoor unit includes support pillars, each of the support pillars having standing wall portions arranged along the up and down direction, and a top plate mounted on upper ends of the support pillars. Substantially horizontal abutment portions extending upward from at least a part of the standing wall portions and being brought into surface contact with a lower surface of the top plate in a state where the top plate is floated up from upper ends of the standing wall portions are provided in the upper end of each of the support pillars.

4 Claims, 9 Drawing Sheets

(51) Int. Cl.
*F24F 1/56* (2011.01)
*F24F 1/50* (2011.01)

(56) References Cited

U.S. PATENT DOCUMENTS

| | | | | | |
|---|---|---|---|---|---|
| 2,028,058 | A | * | 1/1936 | Geyer | 220/688 |
| 2,520,506 | A | * | 8/1950 | Mankki | 312/108 |
| 3,182,846 | A | * | 5/1965 | La Kaff | 220/4.28 |
| 3,220,365 | A | * | 11/1965 | Larson | 108/156 |
| 3,307,894 | A | * | 3/1967 | Collier | 312/265.2 |
| 3,379,481 | A | * | 4/1968 | Fisher | 312/100 |
| 3,994,241 | A | * | 11/1976 | Evans | 108/53.5 |
| 4,309,365 | A | * | 1/1982 | Van Ness et al. | 261/29 |
| 4,553,484 | A | * | 11/1985 | Cox | 108/55.1 |
| 4,600,252 | A | * | 7/1986 | Barber | 312/263 |
| 5,022,719 | A | * | 6/1991 | Amstutz et al. | 312/140 |
| 5,476,315 | A | * | 12/1995 | Lin | 312/265.6 |
| 5,918,551 | A | * | 7/1999 | Liu | 108/55.1 |
| 6,023,898 | A | * | 2/2000 | Josey | 52/309.5 |
| 7,690,613 | B2 | * | 4/2010 | Bowman et al. | 248/346.01 |
| 2003/0122458 | A1 | * | 7/2003 | Choi et al. | 312/265.5 |
| 2005/0150247 | A1 | * | 7/2005 | Ishihara et al. | 62/507 |
| 2012/0218685 | A1 | * | 8/2012 | Gerovac et al. | 361/622 |
| 2013/0047857 | A1 | * | 2/2013 | Bohlen | 96/18 |
| 2014/0047857 | A1 | * | 2/2014 | Sao et al. | 62/259.2 |
| 2014/0124175 | A1 | * | 5/2014 | Sao et al. | 165/121 |
| 2014/0131019 | A1 | * | 5/2014 | Kagawa et al. | 165/121 |
| 2014/0298844 | A1 | * | 10/2014 | Luo et al. | 62/275 |
| 2014/0318173 | A1 | * | 10/2014 | Koike et al. | 62/426 |
| 2014/0326437 | A1 | * | 11/2014 | Kamitani et al. | 165/122 |
| 2014/0338384 | A1 | * | 11/2014 | Koike et al. | 62/285 |

* cited by examiner

CASING OF OUTDOOR UNIT IN AIR CONDITIONING DEVICE

TECHNICAL FIELD

The present invention relates to a casing of an outdoor unit in an air conditioning device.

BACKGROUND ART

As an air conditioning device utilized in a structure such as a building or a general residence, a separate type air conditioning device including an indoor unit and an outdoor unit is widely used. In the outdoor unit of the separate type air conditioning device, for example, as described in Patent Literature 1 to be described below, various devices such as a compressor and a heat exchanger are accommodated inside a casing. The casing of the outdoor unit includes a bottom plate on which various devices are mounted, a plurality of support pillars standing on this bottom plate, a top plate coupled to upper ends of the support pillars, and side surface panels for closing openings between the support pillars.

CITATION LIST

Patent Literature

Patent Literature 1: Japanese Unexamined Patent Publication No. 2009-127991

SUMMARY OF INVENTION

Technical Problem

The outdoor unit as described above is sometimes stacked up in the up and down direction at the time of storage in a warehouse or the like. At this time, a load of the outdoor unit arranged on the upper side is applied downward to the top plate of the casing of the outdoor unit arranged on the lower side. This load is exclusively supported by the support pillars.

However, the support pillars are bent into a square shape, an L shape, or the like in a plan view, and upper end surfaces having a small area of the square shape or the L shape are in contact with the top plate. Thus, contact parts of the top plate receive a large pressure from the support pillars. Particularly, since bent parts (bending parts) of the square shape or the L shape in the support pillars are in contact with the top plate, there is a fear that the stress is concentrated and an impression or deformation is generated.

The present invention is achieved in consideration with the situation described above, and an object thereof is to provide a casing of an outdoor unit capable of suppressing stress concentration generated in a top plate by a force received from support pillars.

Solution to Problem (1) The present invention is a casing of an outdoor unit including support pillars, each of the support pillars having standing wall portions arranged along the up and down direction, and a top plate mounted on upper ends of the support pillars, wherein substantially horizontal abutment portions extending upward from at least a part of the standing wall portions and being brought into surface contact with a lower surface of the top plate in a state where the top plate is floated up from upper ends of the standing wall portions are provided in the upper end of each of the support pillars.

According to the casing with the above configuration, the substantially horizontal abutment portions brought into surface contact with the lower surface of the top plate in a state where the top plate is floated up from the upper ends of the standing wall portions are provided in the upper end of each of the support pillars. Thus, a contact area of the support pillars with the top plate can be increased, and a pressure that the top plate receives from the support pillars can be reduced as far as possible, so that stress concentration generated in the top plate can be suppressed. Further, the abutment portions extend upward from the standing wall portions. Thus, the abutment portions can be integrated with the standing wall portions, so that an increase in the number of parts can be suppressed.

(2) Preferably, buffer portions for easing an impact received from the top plate side are provided between the standing wall portions and the abutment portions.

By providing such buffer portions, even when a strong impact is added to the top plate at the time of stacking the outdoor unit or the like, the impact is eased on the support pillars side, so that generation of excessive stress in the top plate can be suppressed.

(3) Preferably, the buffer portions are formed by curving border portions between the standing wall portions and the abutment portions into a round shape.

Thereby, the buffer portions can be provided with a simple configuration.

(4) Preferably, each of the support pillars has two standing wall portions arranged to match a corner portion of the top plate, and the abutment portions extend from the two standing wall portions.

In such a way, since the abutment portions extend from the two standing wall portions arranged to match the corner portion of the top plate having relatively high strength, deformation or the like of the part of the top plate in surface contact with the abutment portions can be prevented.

(5) Preferably, each of the support pillars has four standing wall portions arranged in a substantially square form in a plan view, two standing wall portions among the standing wall portions are arranged to match a corner portion of the top plate, and the abutment portions extend from the two standing wall portions arranged to match the corner portion of the top plate.

In such a way, since the abutment portions extend from the two standing wall portions arranged to match the corner portion of the top plate having relatively high strength, the deformation or the like of the part of the top plate in surface contact with the abutment portions can be prevented. The upper ends of the two standing wall portions other than the two standing wall portions arranged to match the corner portion of the top plate are also not brought into direct contact with the top plate. Thus, the generation of the stress concentration in the top plate due to contact of the upper ends can be prevented.

(6) Preferably, the top plate is formed in a square shape in a plan view, a flat mount portion is formed in the corner portion of the top plate, regarding each of sides of the top plate, an intermediate part excluding the corner portion serves as a retreat portion set back to the device side, an end of the retreat portion and the mount portion are connected by a standing portion, and the abutment portions of each of the support pillars are in surface contact with a lower surface of the mount portion.

In the top plate having the above configuration, the retreat portion set back to the device side is provided in the intermediate part of the side. Thus, by forming an insertion hole of a screw or a bolt in this retreat portion and fixing the top plate by using this insertion hole, even in a case where a plurality of outdoor units are arranged in a closely-set manner at the time of transportation or at the time of storage, a head part of the screw or the bolt is not butted with the neighboring outdoor unit between the adjacent outdoor units. The flat mount portion is formed in the corner portion of the top plate, and the end of the retreat portion and the mount portion are connected by the standing portion. Therefore, even in a case where a plurality of outdoor units are stacked and stored, a load from the upper outdoor unit can be received by the flat mount portion, and withstand load of the mount portion can be increased by the standing portion functioning as a rib. Therefore, a buffer member arranged between the upper outdoor unit and the lower outdoor unit can be simplified, so that storage cost can be lowered.

Advantageous Effects of Invention

According to the present invention, the stress concentration generated in the top plate by a force received from the support pillars can be suppressed.

DESCRIPTION OF EMBODIMENTS

Figure 1:
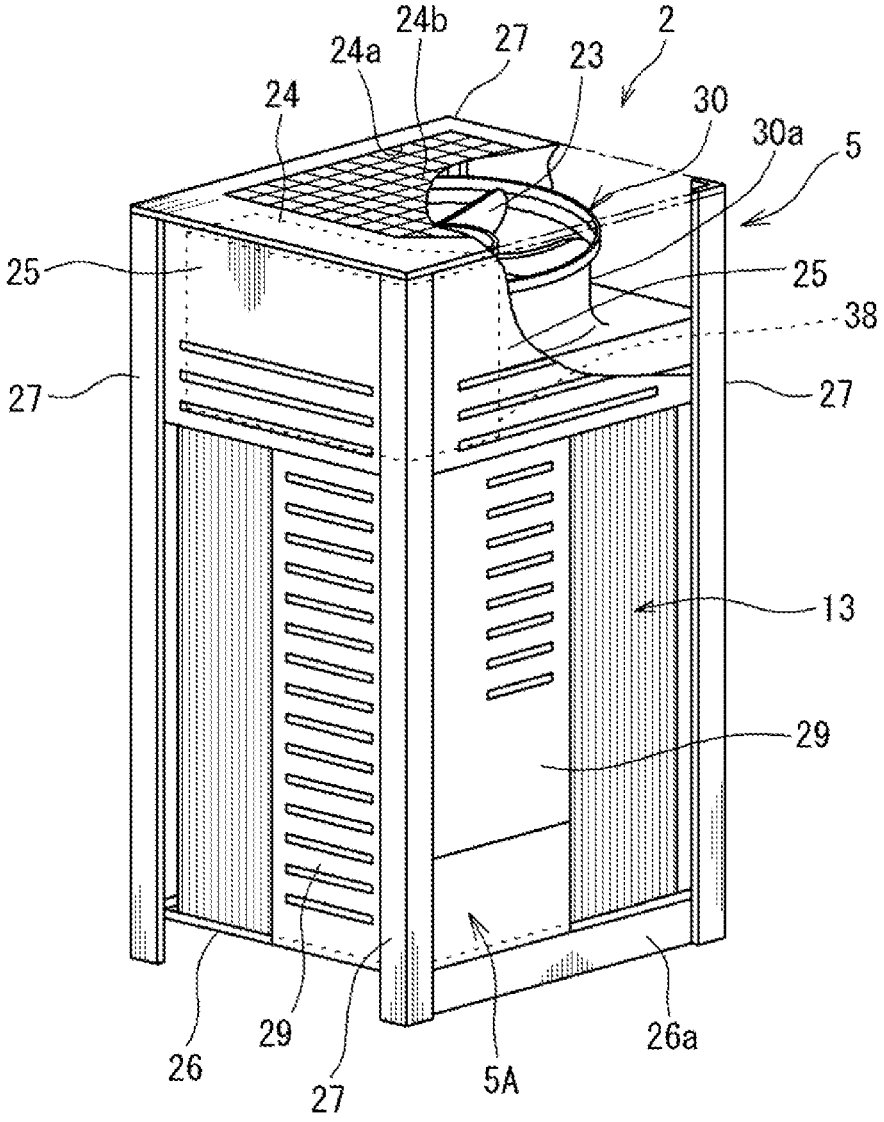
FIG. 1 is a perspective view schematically showing an outer appearance and an interior of a part of an outdoor unit of an air conditioning device according to a first embodiment of the present invention.
Figure 2:
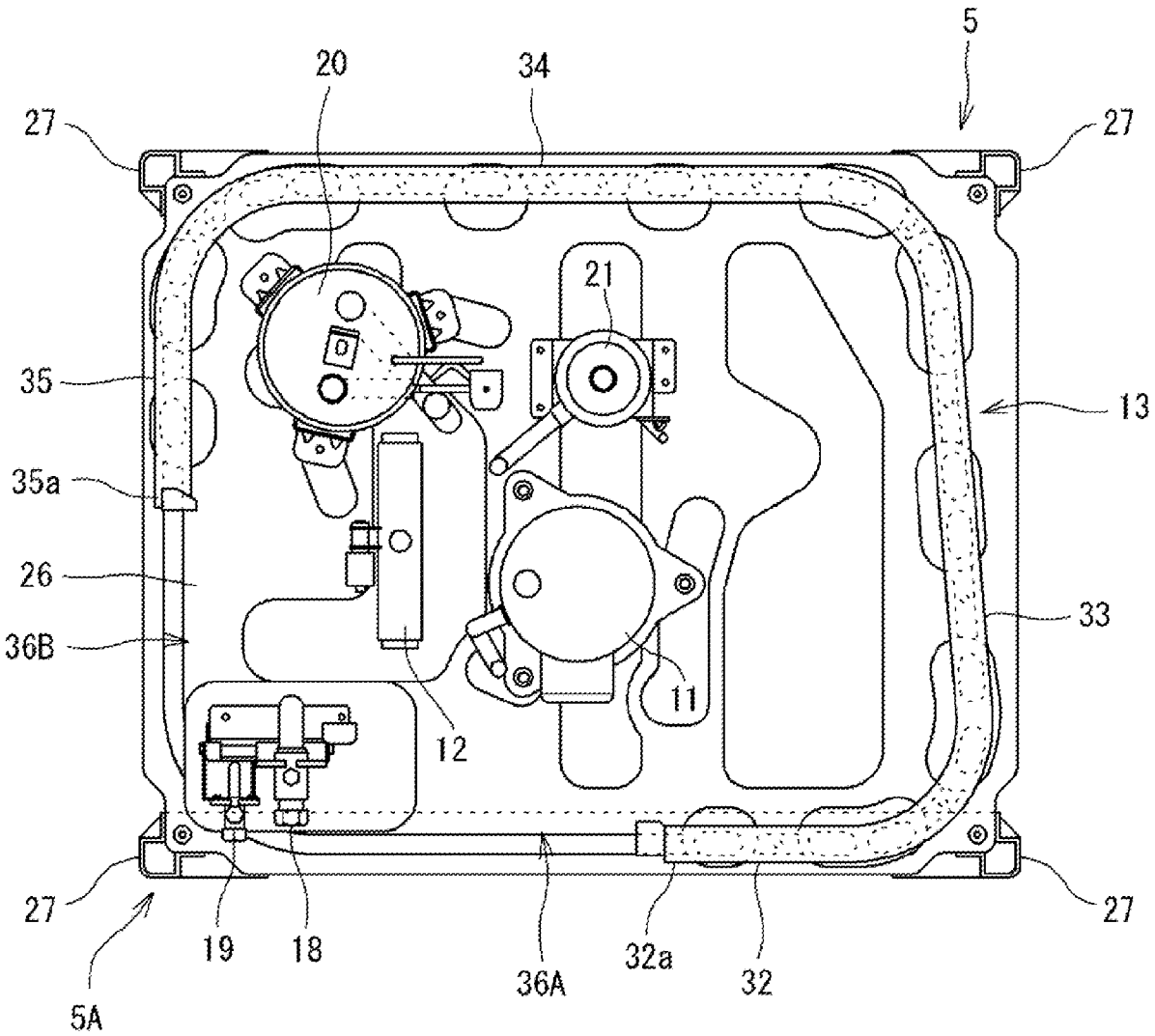
FIG. 2 is a plan view showing the interior of the outdoor unit.

FIG. 1 is a perspective view schematically showing an outer appearance and an interior of a part of an outdoor unit of an air conditioning device according to a first embodiment of the present invention, and FIG. 2 is a plan view showing the interior of the outdoor unit.

An outdoor unit 2 of the present embodiment is used in for example a multiple type air conditioning device for a building, and includes a casing (outdoor unit main body) 5, devices such as an outdoor heat exchanger 13, a compressor 11, a four way valve 12, an accumulator 20, and an oil separator 21, which are built in this casing 5 and forming a refrigerant circuit, an electric component unit 38, and a fan 23. The outdoor unit 2 is an upward blowing type in which the air is suctioned from a side surface of the casing 5 by driving the fan 23, heat exchange is performed with the outdoor heat exchanger 13, and then the air is blown out upward from an upper part of the casing 5.

The casing 5 is formed into a substantially cubic shape, and has a bottom frame 26, support pillars 27, lower side surface panels 29, upper side surface panels 25, a top plate 24, and the like. The bottom frame 26 is formed into a square shape in a plan view. Leg portions 26*a* connected to the ground are provided in two sides facing front and rear side parts. The support pillars 27 are formed by a long member elongated in the up and down direction, and attached to four corners of the bottom frame 26 by bolts or the like. It should be noted that although FIG. 1 shows a state where the shape of the support pillars 27 is simplified (with substantially L shape sections), the support pillars 27 of the present embodiment are formed in a shape shown in FIGS. 2 to 5. A detailed structure of the support pillars 27 will be described later.

As shown in FIG. 1, the top plate 24 is formed into a square shape in a plan view which is the substantially same as the bottom frame 26, and arranged so as to have a gap above the bottom frame 26. Four corners of the top plate 24 are mounted on upper ends of the support pillars 27, and the top plate 24 is coupled to the upper side surface panels 25 and the like by coupling tools such as bolts. A substantially square ventilating hole 24*a* is formed in the top plate 24, and a grille 24*b* for preventing invasion of foreign substances is provided in this ventilating hole 24*a*.

A bell mouth 30 is attached to an upper part of the casing 5. This bell mouth 30 has a ventilating guide (ventilating member) 30*a* surrounding an outer circumference part of the fan 23. The ventilating guide 30*a* is formed into a cylindrical shape along a circular rotation trajectory of the fan 23, to form a blow-out port of the air from the casing 5.

The upper side surface panels 25 are provided on four side surfaces of the casing 5 around the bell mouth 30. The fan 23, the bell mouth 30, and the electric component unit 38 are covered by the upper side surface panels 25 and the top plate 24 so as not to be exposed to an exterior.

As shown in FIG. 2, the devices such as the outdoor heat exchanger 13, the compressor 11, stop valves 18 and 19, the accumulator 20, the oil separator 21, and the four way valve 12 are mounted on the bottom frame 26 of the casing 5. The outdoor heat exchanger 13 is of a cross fin coil type in which a heat transfer tube horizontally passes through a large number of aluminum fins and the heat exchange is performed between a refrigerant flowing through the heat transfer tube and the air circulated in the outdoor heat exchanger 13.

The outdoor heat exchanger 13 is bent in a substantially square shape so as to face (correspond to) the four side surfaces in a range excluding one corner portion (left front corner portion) 5A of the casing 5 along the four side surfaces. Specifically, the outdoor heat exchanger 13 has a front heat exchange portion 32 along the side surface on the front side of the casing 5 (front surface), a right heat exchange portion 33 along the side surface on the right side, a rear heat exchange portion 34 along the side surface on the rear side (rear surface), and a left heat exchange portion 35 along the side surface on the left side. A part between the front heat exchange portion 32 and the right heat exchange portion 33, a part between the right heat exchange portion 33 and the rear heat exchange portion 34, and a part between the rear heat exchange portion 34 and the left heat exchange portion 35 are bent at substantially 90 degrees.

The casing 5 includes opening portions 36A and 36B to be openably closed by the lower side surface panels 29 (refer to FIG. 1) between one side end portion 32*a* of the outdoor heat exchanger 13 (left end portion of the front heat exchange portion 32) and the left front support pillar 27, and between this support pillar 27 and the other side end portion 35*a* of the outdoor heat exchanger 13 (front end portion of the left heat exchange portion 35), respectively.

The stop valves 18 and 19 are supported via an attachment base so as to face the front opening portion 36A of the casing 5. The compressor 11 is arranged closely to a right side part of the front opening portion 36A at such a position that the substantially entire compressor can be visually recognized from the front side via the front opening portion 36A. The accumulator 20 and the oil separator 21 on the bottom frame 26 are arranged on the rear part side in the casing 5.

Figure 3:
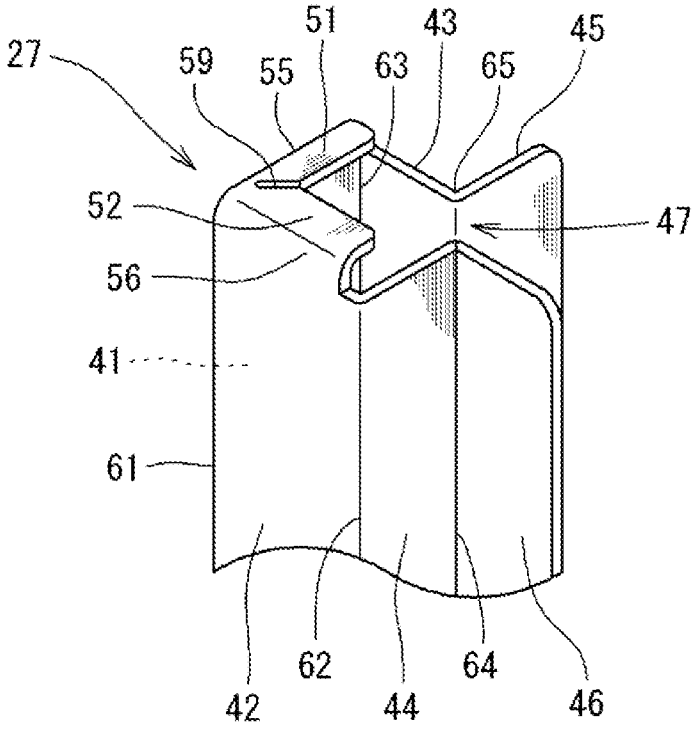
FIG. 3 is a perspective view showing an upper part of a support pillar of a casing in the outdoor unit.
Figure 4:
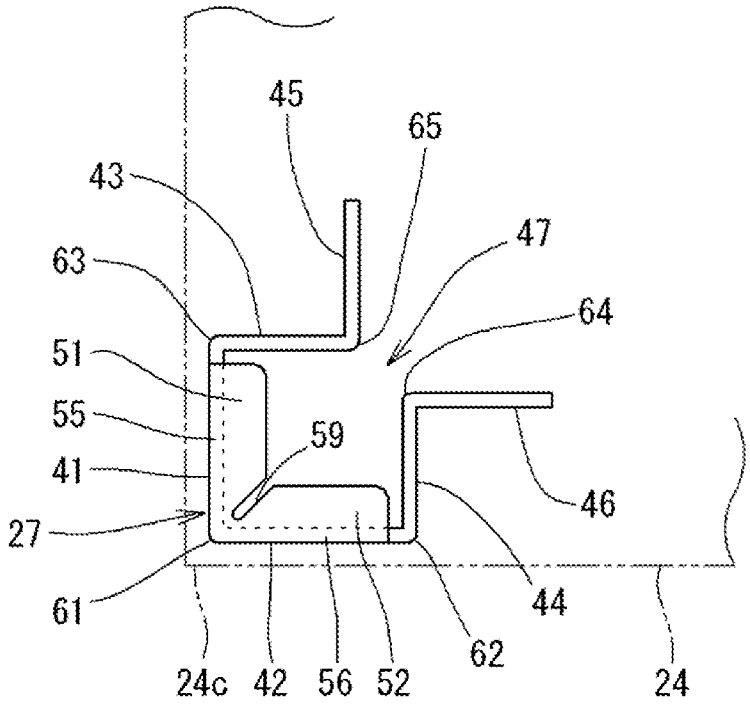
FIG. 4 is a plan view of the support pillar.
Figure 5:
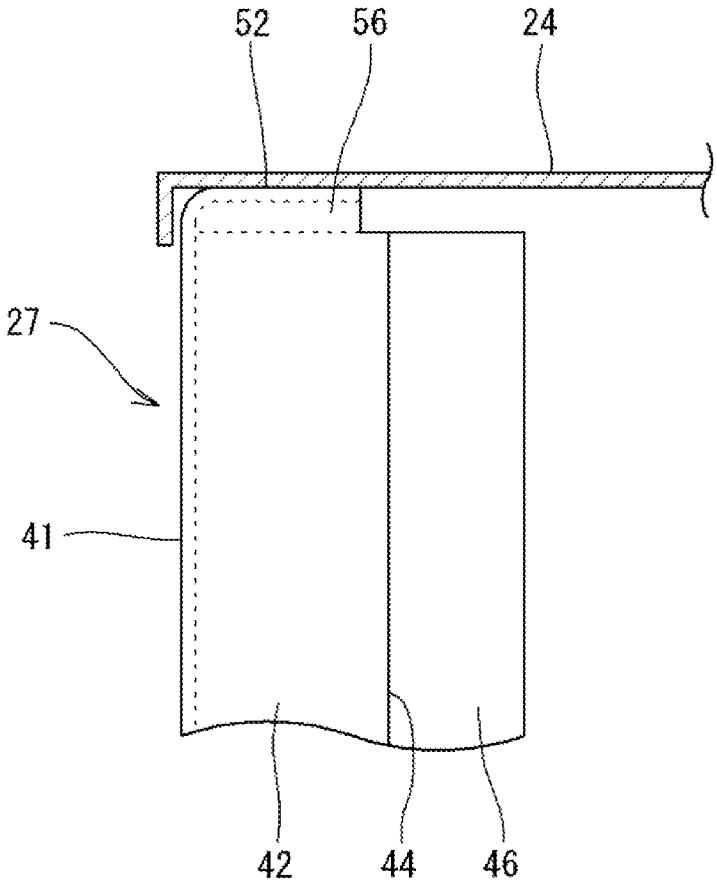
FIG. 5 is a front view of the support pillar.

FIG. 3 is an enlarged perspective view showing an upper part of the support pillar of the casing in the outdoor unit, FIG. 4 is a plan view of the support pillar, and FIG. 5 is a front view of the support pillar.

Each of the support pillars 27 includes a plurality of standing wall portions 41 to 46 arranged along the up and down direction. Specifically, the support pillar 27 has first to fourth standing wall portions 41 to 44 arranged in a substantially square form in a plan view. The first and second standing wall portions 41 and 42 are bent at substantially 90 degrees with respect to each other, and arranged to match a corner portion 24*c* of the top plate 24. The third standing wall portion 43 is bent at substantially 90 degrees with respect to the first standing wall portion 41, so as to face the second standing wall portion 42 in substantially parallel. The fourth standing wall portion 44 is bent at substantially 90 degrees with respect to the second standing wall portion 42, so as to face the first standing wall portion 41 in substantially parallel. An opening 47 is formed between the third standing wall portion 43 and the fourth standing wall portion 44.

Further, the support pillar 27 has fifth and sixth standing wall portions 45 and 46. The fifth standing wall portion 45 is bent at substantially 90 degrees with respect to the third standing wall portion 43, and arranged in substantially parallel to the first standing wall portion 41. The sixth standing wall portion 46 is bent at substantially 90 degrees with respect to the fourth standing wall portion 44, and arranged in substantially parallel to the second standing wall portion 42. The fifth and sixth standing wall portions 45 and 46 serve as attachment portions at the time of attaching the bottom frame 26, the side surface panels 25 and 29, and the like to the support pillar 27.

A first abutment portion 51 extends in an upper end of the first standing wall portion 41. This first abutment portion 51 is bent at substantially 90 degrees with respect to the first standing wall portion 41, and arranged substantially horizontally. A second abutment portion 52 extends in an upper end of the second standing wall portion 42. This second abutment portion 52 is bent at substantially 90 degrees with respect to the second standing wall portion 42, and arranged substantially horizontally. The top plate 24 is mounted on upper surfaces of the first and second abutment portions 51 and 52 so as to be supported by the support pillar 27. That is, due to the first and second abutment portions 51 and 52, the top plate 24 is not brought into direct contact with upper ends of the standing wall portions 41 to 46 but supported in a state where the top plate is floated up from the upper ends.

A border portion 55 between the first standing wall portion 41 and the first abutment portion 51, and a border portion 56 between the second standing wall portion 42 and the second abutment portion 52 are curved in a round shape. By this structure, the first abutment portion 51 and the second abutment portion 52 are easily elastically deformed in the up and down direction. Since these border portions 55 and 56 are formed in a round shape, no sharp edges are created, so that the border portions 55 and 56 are not directly abutted with the top plate 24.

A cut 59 is formed between the first abutment portion 51 and the second abutment portion 52. The border portions 55 and 56 are formed in such a shape that the portions are continuous to each other.

The above outdoor units 2 are sometimes stacked in the up and down direction for example at the time of storage in a warehouse or the like. At this time, a downward load is applied to the top plate 24 of the outdoor unit 2 arranged on the lower side, and the top plate 24 receives an upward load from the support pillars 27 as a reactive force against the downward load. The top plate 24 of the outdoor unit 2 is mounted on the substantially horizontal first and second abutment portions 51 and 52, and brought into surface contact with the first and second abutment portions 51 and 52, so that a contact area between the top plate and the support pillars 27 is increased. Therefore, even when the upward load (reactive force) is received from the support pillars 27, a pressure applied to the top plate 24 can be decreased, so that stress concentration generated in the top plate 24 can be suppressed.

Bent portions 61 to 65 are formed between the standing wall portions 41 to 46 of the support pillar 27. The stress is easily concentrated particularly in a part of the top plate 24 in contact with these bent portions 61 to 65. However, since the top plate 24 is floated up from the upper ends of the standing wall portions 41 to 46 of the support pillar 27 in the present embodiment, the top plate is also not brought into contact with the bent portions 61 to 65. Therefore, the stress concentration can be effectively suppressed.

The border portions 55 and 56 between the first and second standing wall portions 41 and 42 and the first and second abutment portions 51 and 52 are formed to be curved in a round shape, and the first and second abutment portions 51 and 52 are easily elastically deformed in the up and down direction. Thus, even in a case where a large impact is applied to the top plate 24 at the time of stacking the outdoor unit 2 or the like, the impact is eased by elastic deformation of the first and second abutment portions 51 and 52, so that deformation and damage of the top plate 24 can be prevented. The border portions 55 and 56 between the first and second standing wall portions 41 and 42 and the first and second abutment portions 51 and 52 function as buffer portions for easing the impact applied to the top plate 24. Since the cut 59 is formed between the first and second abutment portions 51 and 52, the first and second abutment portions 51 and 52 are more easily elastically deformed in the up and down direction, so that the function of easing the impact applied to the top plate 24 is enhanced.

The first and second abutment portions 51 and 52 extend from the first and second standing wall portions 41 and 42 arranged to match the corner portion 24*c* of the top plate 24 having relatively high strength. Thus, the deformation and the like of the top plate 24 in the part in surface contact with the first and second abutment portions 51 and 52 can be favorably prevented.

It should be noted that in a case where a plurality of outdoor units 2 are stacked, a buffer member for easing the impact is generally inserted between both the outdoor units. However, since the border portions 55 and 56 functioning as the buffer portions are provided in the support pillars 27 as described above, thickness of the buffer member can be reduced and the structure can be simplified.

Figure 6:
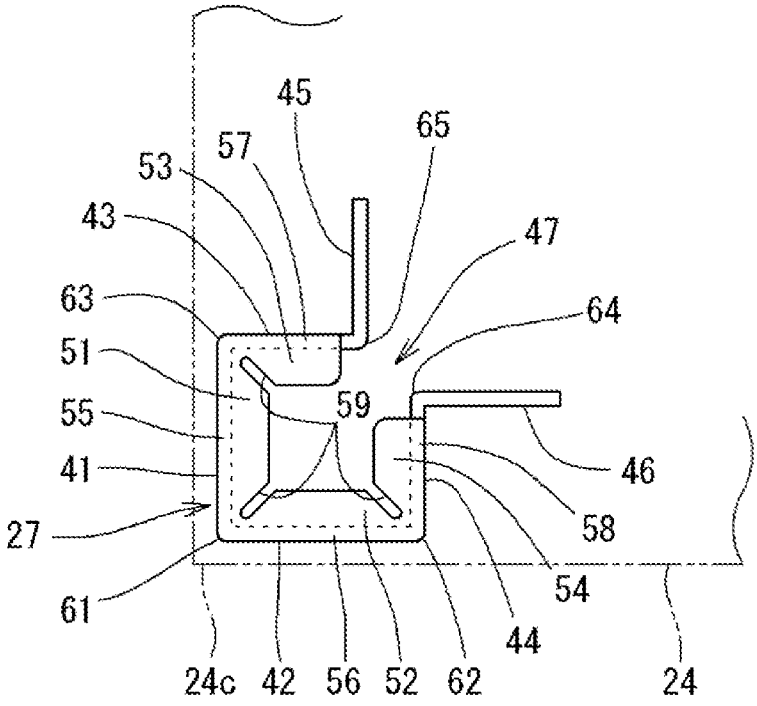
FIG. 6 is a plan view of a support pillar in a second embodiment of the present invention.

FIG. 6 is a plan view of a support pillar in a second embodiment of the present invention. In the present embodiment, not only in the first and second standing wall portions 41 and 42 of the support pillar 27 but also in the third and fourth standing wall portions 43 and 44, abutment portions (third and fourth abutment portions) 53 and 54 are provided. Therefore, the contact area between the support pillar 27 and the top plate 24 is increased more than the first embodiment, so that the stress concentration is more reduced. Border portions 57 and 58 between the third and fourth standing wall portions 43 and 44 and the third and fourth abutment portions 53 and 54 are curved in a round shape. Therefore, the effect of easing the impact received by the top plate 24 is more improved.

Figure 7:
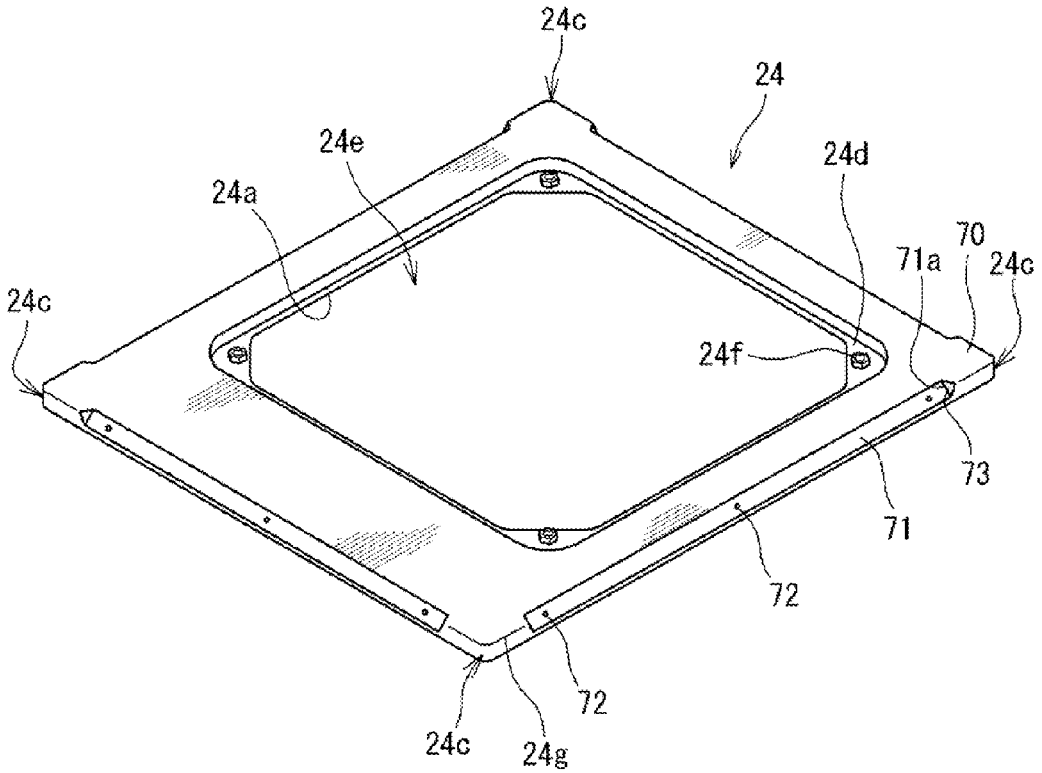
FIG. 7 is a perspective view showing a top plate in a third embodiment of the present invention.

FIG. 7 is a perspective view showing a top plate in a third embodiment of the present invention.

A bottom portion 24*d* slightly lower than a surface of the top plate 24 is formed in a peripheral edge of the ventilating port 24*a* of the top plate 24 in this example. A recess 24*e* is formed by this bottom portion 24*d*. Nuts 24*f* are secured to four corners of this bottom portion 24*d*, and the grille 24*b* (refer to FIG. 1) is arranged in the recess 24*e* by using the nuts 24*f* and bolts (not shown).

Flat mount portions 70 are formed in the four corner portions 24*c* of the top plate 24. Regarding each of sides of the top plate 24, an intermediate part excluding the corner portions 24*c* of the top plate 24, in other words, a part between the mount portions 70 on both ends of the side is an inclined surface 71 serving as a retreat portion. This "retreat portion" is a part whose surface is set back to the device interior side from edges 24*g* of the corner portions 24*c* of the top plate 24. A space formed by this set-back is not butted with the closely arranged other outdoor unit.

Insertion holes 72 for screws are formed on the inclined surface 71 at predetermined intervals, and the top plate 24 is attached to an upper edge of the upper side surface panel 25 with the screws (not shown) by utilizing the insertion holes 72. It should be noted that the upper edge of the upper side surface panel 25 is bent inward in correspondence with inclination of the inclined surface 71 of the top plate 24. Head parts of the screws are placed in the set-back space of the inclined surface 71. Thus, even in a case where the plurality of outdoor units are transported and stored in a closely-set manner, the head parts of the screws are not butted with the casing of the adjacent outdoor unit. Even in a case where the buffer member is inserted between the plurality of outdoor units, there is no need for forming a part of absorbing the head parts of the screws in this buffer member. Thus, the buffer member can be simplified and formed in an uncomplicated shape.

The mount portion 70 formed in each of the corner portions 24*c* of the top plate 24, and an end 71*a* of the inclined surface 71 are connected by a standing portion including a substantially triangle vertical surface 73. The flat mount portion 70 can receive a load in the vertical direction and the vertical surface 73 functions as a rib. Thus, withstand load of the top plate 24 can be increased. Therefore, in a case where the plurality of outdoor units 2 are stacked and stored, there is no need for inserting a thick buffer member between both the outdoor units, so that the buffer member can be simplified and formed in an uncomplicated shape. As a result, cost of the buffer member can be reduced, so that storage cost of the outdoor unit 2 can be reduced.

Figure 8:
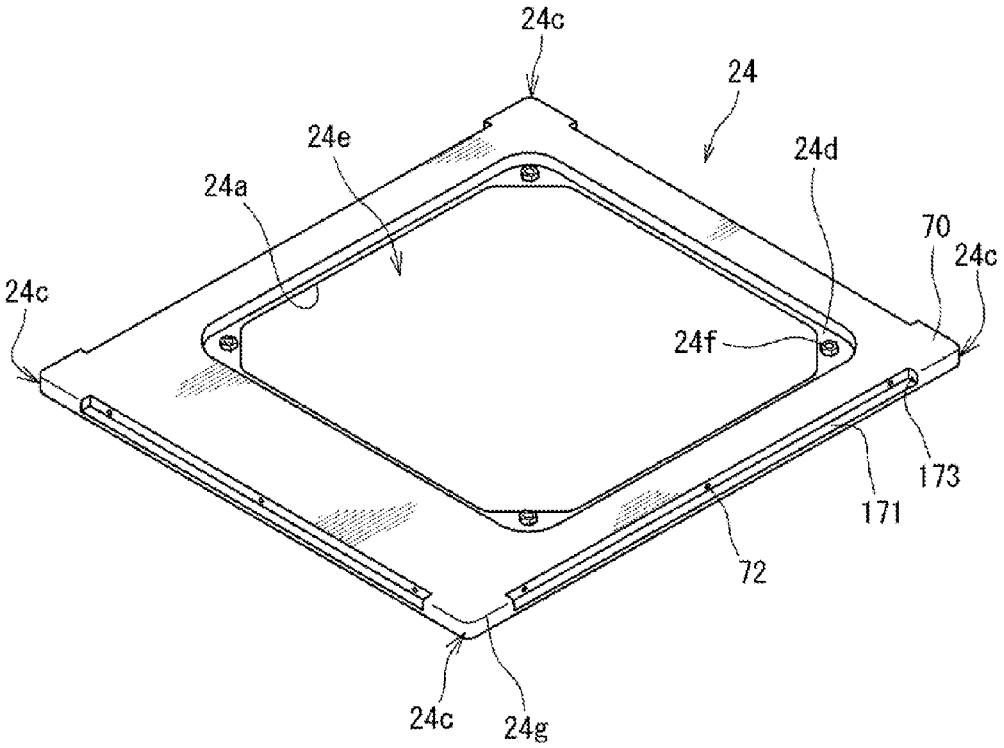
FIG. 8 is a perspective view showing a top plate in a fourth embodiment of the present invention.

FIG. 8 is a perspective view showing a top plate in a fourth embodiment of the present invention.

In the top plate 24 of this embodiment, the retreat portion between the corner portions 24*c* is formed, not in the inclined surface 71 as in the third embodiment, but in a step portion 171 bent at substantially 90 degrees. Therefore, as well as the third embodiment, butting with the head parts of the screws inserted into the insertion holes 72 can be prevented. In the present embodiment, a substantially square vertical surface 173 is adopted as a standing portion for connecting an end of the retreat portion 171 and the mount portion 70.

Figure 9A:
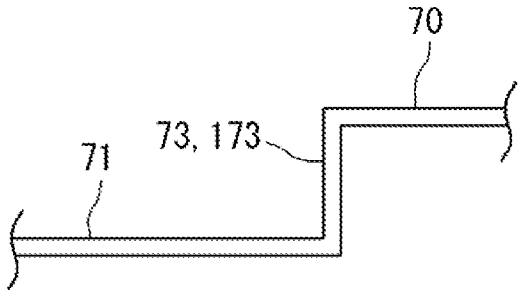
FIGS. 9(*a*) to 9(*c*) are illustrative sectional views of a standing portion of the top plate.
Figure 9B:
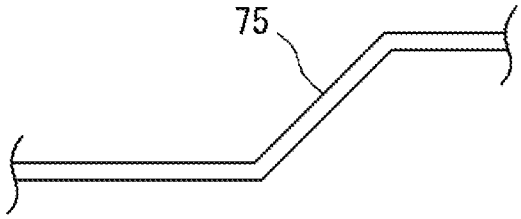
Figure 9C:
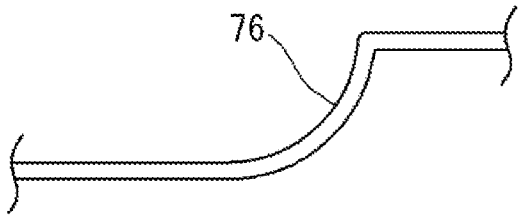

In the above third and fourth embodiments, the standing portion is formed by the vertical surface 73 or 173 which is substantially vertical to the mount portion 70 (refer to FIG. 9(*a*)). However, in addition, an inclined surface 75 shown in FIG. 9(*b*) or a rounded surface 76 shown in FIG. 9(*c*) can serve as the standing portion. The inclined surface 75 and the rounded surface 76 function as ribs and contribute to an increase in withstand load of the mount portion 70.

The present invention is not limited to the above embodiments but can be appropriately changed within the scope of the invention described in the claims.

For example, the shape of the support pillar 27 is not limited to the above embodiments but can be appropriately changed. For example, the fifth and sixth standing wall portions 45 and 46 can be omitted from the support pillar 27. The support pillar 27 can also be formed in a square tube shape in which no opening 47 is provided by omitting the fifth and sixth standing wall portions 45 and 46 and connecting the third standing wall portion 43 and the fourth standing wall portion 44. The support pillar 27 can also be formed in a shape including only the first and second standing wall portions 41 and 42 (substantially L shape in a plan view).

In any case, the abutment portion can extend from at least one standing wall portion. However, in order to sufficiently ensure the contact area with the top plate 24, the abutment portions preferably extend from two or more standing wall portions.

In the above embodiments, the abutment portions 51 to 54 are bent toward the inner side of the standing wall portions 41 to 44. However, the abutment portions may be bent toward the outer side.

The present invention is not limited to the upward blowing type outdoor unit 2 but can be applied to any outdoor unit including the casing 5 which has the support pillars 27 and the top plate 24.

REFERENCE SIGNS LIST

2: OUTDOOR UNIT
5: CASING
24: TOP PLATE
24*c*: CORNER PORTION
27: SUPPORT PILLAR
41: FIRST STANDING WALL PORTION
42: SECOND STANDING WALL PORTION
43: THIRD STANDING WALL PORTION
44: FOURTH STANDING WALL PORTION
45: FIFTH STANDING WALL PORTION
46: SIXTH STANDING WALL PORTION
51: FIRST ABUTMENT PORTION
52: SECOND ABUTMENT PORTION
53: THIRD ABUTMENT PORTION
54: FOURTH ABUTMENT PORTION
55 to 58: BORDER PORTION (BUFFER PORTION)
70: MOUNT PORTION
71: INCLINED SURFACE (RETREAT PORTION)
73: VERTICAL SURFACE (STANDING PORTION)
75: INCLINED SURFACE (STANDING PORTION)
76: ROUNDED SURFACE (STANDING PORTION)
171: STEP PORTION (RETREAT PORTION)
173: VERTICAL SURFACE (STANDING PORTION)

The invention claimed is:

1. A casing of an outdoor unit in an air conditioning device, the casing comprising:

support pillars, each of the support pillars having standing wall portions arranged along the up and down direction; and a top plate mounted on upper ends of the support pillars, wherein substantially horizontal abutment portions extending upward from at least a part of the standing wall portions and being brought into surface contact with a lower surface of a planar portion of the top plate in a state where the top plate is floated up from upper ends of the standing wall portions are provided in the upper end of each of the support pillars, buffer portions for buffering an impact received from the top plate side are provided between the standing wall portions and the abutment portions, and the buffer portions are curved border portions extending from the standing wall portions to the abutment portions, the border portions and the abutment portions being configured such that the abutment portions are elastically deformable in a vertical direction.

2. A casing of an outdoor unit in an air conditioning device, the casing comprising:

support pillars, each of the support pillars having standing wall portions arranged along the up and down direction; and a top plate mounted on upper ends of the support pillars, wherein substantially horizontal abutment portions extending upward from at least a part of the standing wall portions and being brought into surface contact with a lower surface of a planar portion of the top plate in a state where the top plate is floated up from upper ends of the standing wall portions are provided in the upper end of each of the support pillars, each of the support pillars has two standing wall portions arranged to match a corner portion of the top plate, the abutment portions extend from the two standing wall portions, buffer portions for buffering an impact received from the top plate side are provided between the standing wall portions and the abutment portions, and the buffer portions are curved border portions extending from the standing wall portions to the abutment portions, the border portions and the abutment portions being configured such that the abutment portions are elastically deformable in a vertical direction.

3. A casing of an outdoor unit in an air conditioning device, the casing comprising:

support pillars, each of the support pillars having standing wall portions arranged along the up and down direction; and a top plate mounted on upper ends of the support pillars, wherein substantially horizontal abutment portions extending upward from at least a part of the standing wall portions and being brought into surface contact with a lower surface of a planar portion of the top plate in a state where the top plate is floated up from upper ends of the standing wall portions are provided in the upper end of each of the support pillars, each of the support pillars has four standing wall portions arranged in a substantially square form in a plan view, two standing wall portions among the standing wall portions are arranged in a corner portion of the top plate, the abutment portions extend from the two standing wall portions arranged to match the corner portion of the top plate, buffer portions for buffering an impact received from the top plate side are provided between the standing wall portions and the abutment portions, and the buffer portions are curved border portions extending from the standing wall portions to the abutment portions, the border portions and the abutment portions being configured such that the abutment portions are elastically deformable in a vertical direction.

4. A casing of an outdoor unit in an air conditioning device, the casing comprising:

support pillars, each of the support pillars having standing wall portions arranged along the up and down direction; and a top plate mounted on upper ends of the support pillars, wherein substantially horizontal abutment portions extending upward from at least a part of the standing wall portions and being brought into surface contact with a lower surface of the top plate in a state where the top plate is floated up from upper ends of the standing wall portions are provided in the upper end of each of the support pillars, the top plate is formed in a square shape in a plan view, a flat mount portion is formed in the corner portion of the top plate, regarding each of sides of the top plate, an intermediate part excluding the corner portion serves as a retreat portion set back to the device side, an end of the retreat portion and the mount portion are connected by a standing portion, the abutment portions of each of the support pillars are in surface contact with a lower surface of a planar portion of the mount portion, buffer portions for buffering an impact received from the top plate side are provided between the standing wall portions and the abutment portions, and the buffer portions are curved border portions extending from the standing wall portions to the abutment portions, the border portions and the abutment portions being configured such that the abutment portions are elastically deformable in a vertical direction.

* * * * *